US006761530B1

(12) United States Patent
Ginessin et al.

(10) Patent No.: US 6,761,530 B1
(45) Date of Patent: Jul. 13, 2004

(54) METHOD AND APPARATUS TO FACILITATE REDUCING TURBINE PACKING LEAKAGE LOSSES

(75) Inventors: Leonid Julievich Ginessin, Moscow (RU); Anil Kumar Tolpadi, Niskayuna, NY (US); William Hunter Boardman, IV, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/394,126

(22) Filed: Mar. 21, 2003

(51) Int. Cl.[7] ..... F01D 11/02

(52) U.S. Cl. ..... 415/173.7; 415/174.5; 415/230

(58) Field of Search ..... 415/174.5, 173.5, 415/230, 173.7; 277/303, 412, 418

(56) References Cited

U.S. PATENT DOCUMENTS 5,181,728 A * 1/1993 Stec ..... 277/355
5,244,216 A * 9/1993 Rhode ..... 277/303
6,102,655 A * 8/2000 Kreitmeier ..... 415/173.3

* cited by examiner

*Primary Examiner*—Ninh H. Nguyen
(74) *Attorney, Agent, or Firm*—Armstrong Teasdale LLP

(57) ABSTRACT

A method for sealing between a rotary component and a stationary component. The method including positioning a seal assembly having a plurality of teeth adjacent the stationary component and positioning a packing surface to interface with the rotary component. The packing surface at the rotary component includes at least one step that has an axial width that is approximately equal to a distance the rotary component axially shifts relative to the stationary component during transition from startup to steady state operating conditions.

12 Claims, 5 Drawing Sheets

METHOD AND APPARATUS TO FACILITATE REDUCING TURBINE PACKING LEAKAGE LOSSES

BACKGROUND OF THE INVENTION

The present invention relates generally to rotary machines, and, more particularly, to methods and apparatus to facilitate reducing packing leakage losses in rotary machines.

Steam and gas turbines are used, among other purposes, to generate power for electric generators. A steam turbine has a flow path which typically includes, in serial-flow relationship, a steam inlet, a turbine, and a steam outlet. A gas turbine has a gas path which typically includes, in serial-flow relationship, an air intake (or inlet), a compressor, a combustor, a turbine, and a gas outlet (or exhaust nozzle). Compressor and turbine sections include at least one row of circumferentially-spaced rotating blades.

Turbine efficiency depends at least in part on controlling the radial clearance or gap defined between the tips of the rotor blade and the casing, and maintaining a clearance between the rotor and adjacent diaphragm or end packings. If either clearance is too large, steam or gas flow may leak through the clearance gaps, thus decreasing the turbine's efficiency. Alternatively, if either clearance is too small, the rotor blade tips may undesirably contact the surrounding casing during certain turbine operating conditions. Gas or steam leakage, either out of the flow path or into the flow path, from an area of higher pressure to an area of lower pressure, is generally undesirable.

To facilitate minimizing gas-path leakage, at least some known turbines use a plurality of labyrinth seals. Known labyrinth seals include longitudinally spaced-apart rows of labyrinth seal teeth to seal against high-pressure differentials that may be present in a turbine. However, labyrinth seals may wear-out after extended use, and prior to replacement, worn labyrinth seals may be ineffective for controlling leakage of fluid between the areas of generally high and low pressure. Furthermore, because of changing centrifugal forces induced to the blade tips, and thermal growth differences between the rotating rotor and stationary casing, the effectiveness of the labyrinth seals may be limited as the operating clearances change during periods of acceleration, deceleration, or transient operations during turbine startup. More specifically, during periods of differential centrifugal and thermal growth of the rotor and casing, clearance changes may cause undesirable rubbing of the moving blade tips against the stationary casing. A resulting increase in blade tip clearance may result in additional efficiency loss.

The anchor positions of the stationary parts do not typically align with the rotor thrust bearing and the steady state temperature of the rotor is typically hotter than the shells, therefore the thermal expansions of these components can result in large relative movements between the rotating and stationary parts, especially for the low pressure sections of steam turbines when the trust bearing is placed far from this section. The ability to predict (calculate) these relative axial differential expansions between the rotating and stationary parts, hereinafter referred as "axial shift", fosters the use of this invention. All design variations of the invention serve to open radial clearances to avoid rubs during start-up (cold condition), when rotor vibrations are highest, and to close (tighten) the radial clearances during steady state (hot condition) to effectively lower secondary flow losses and increase machine efficiency.

BRIEF DESCRIPTION OF THE INVENTION

In one aspect, a method for sealing between a rotary component and a stationary component. The method including positioning a seal assembly having a plurality of teeth adjacent the stationary component and positioning a packing surface to interface with the rotary component. The packing surface at the rotary component includes at least one step that has an axial width that is approximately equal to a distance the rotary component axially shifts relative to the stationary component during transition from startup to steady state operating conditions.

In another aspect of the invention, a seal assembly for use in a turbine is provided. The seal assembly includes a rotary component including a packing surface and a stationary component including a plurality of teeth extending from the stationary component towards the packing surface. The packing surface including at least one step having an axial width that is approximately equal to a distance the rotary component axially shifts relative to the stationary component when the turbine transitions from a startup to a steady-state condition such that the seal assembly facilitates sealing between the rotary component and the stationary component.

In a further aspect, a turbine is provided. The turbine includes a housing, a rotor shaft rotatably coupled within the housing, a diaphragm coupled to the housing; and a seal assembly extending between the rotor shaft and the diaphragm. The seal assembly includes a rotary component including a packing surface and a stationary component including a plurality of teeth extending from the diaphragm stationary housing towards the packing surface to provide a seal therebetween. The packing surface comprising at least one step having an axial width that is approximately equal to a distance of axial shift of the rotary component relative to the stationary component when the turbine transitions from a startup to a steady state condition such that the seal assembly facilitates sealing between the rotary component and the stationary component.

DETAILED DESCRIPTION OF THE INVENTION

Figure 1:
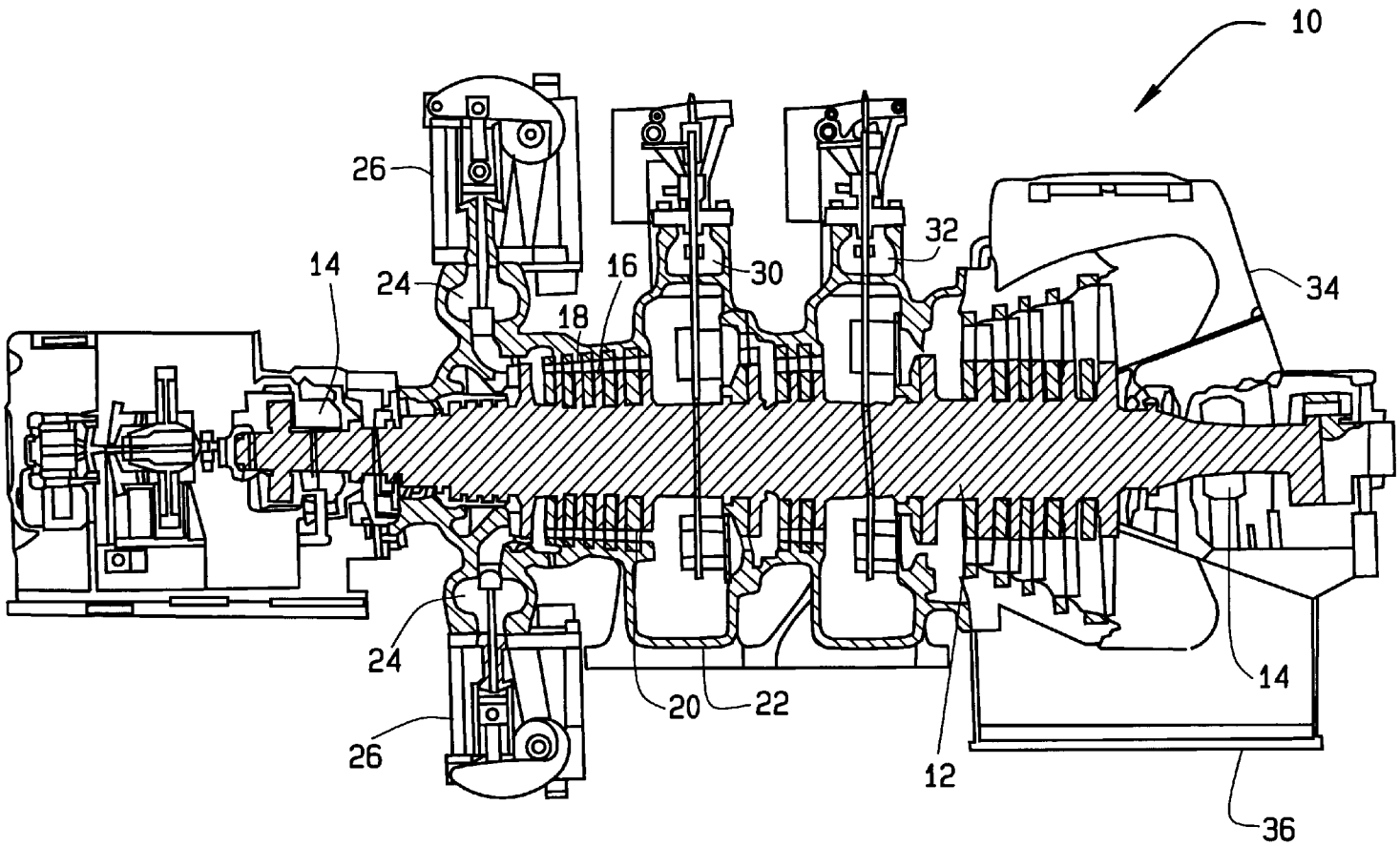
FIG. 1 is a cross-sectional view of an exemplary steam turbine.

FIG. 1 is a cross-sectional view of an exemplary steam turbine 10. Steam turbine 10 includes a shaft 12 extending through turbine 10 and rotatably supported at each end by bearing supports 14. A plurality of rows of turbine blades 16 are coupled to shaft 12, and a plurality of stationary turbine nozzles 18 are positioned between adjacent rows of turbine blades 16. Turbine blades 16 are coupled to turbine shaft 12, and turbine nozzles 18 are coupled to support members or nozzle diaphragms 20 attached to a housing or shell 22 surrounding turbine blades 16 and nozzles 18. Steam inlet ports 24 channel steam supplied from a steam source into turbine 10, and main steam control valves 26 control the flow of steam into turbine 10.

In operation, steam is directed through nozzles 18 to impact blades 16, which causes blades 16 to rotate with turbine shaft 12. A portion of steam discharged through nozzles 18 enters extraction chambers 30 and 32, and a predetermined amount of steam is also routed to various feedwater heaters (not shown). After the steam passes through turbine blades 16, the steam is discharged through steam exhaust casing 34 and exhaust outlet 36 and returned to a condenser (not shown) for recovery.

Figure 2:
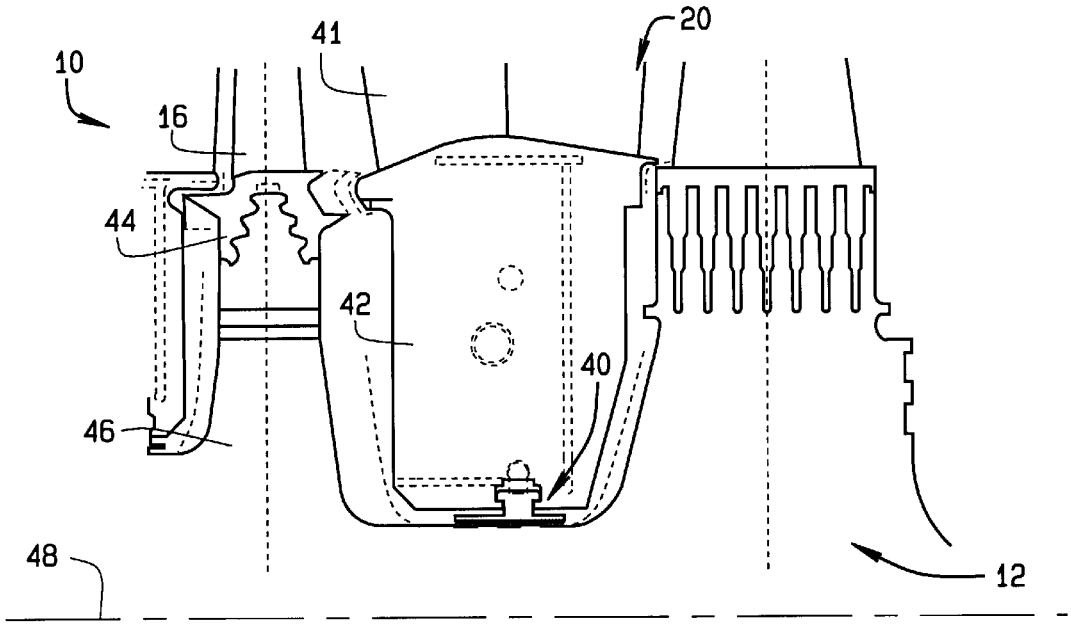
FIG. 2 is a cross-sectional view of an exemplary seal assembly that may be used with the steam turbine shown in FIG. 1.
Figure 3:
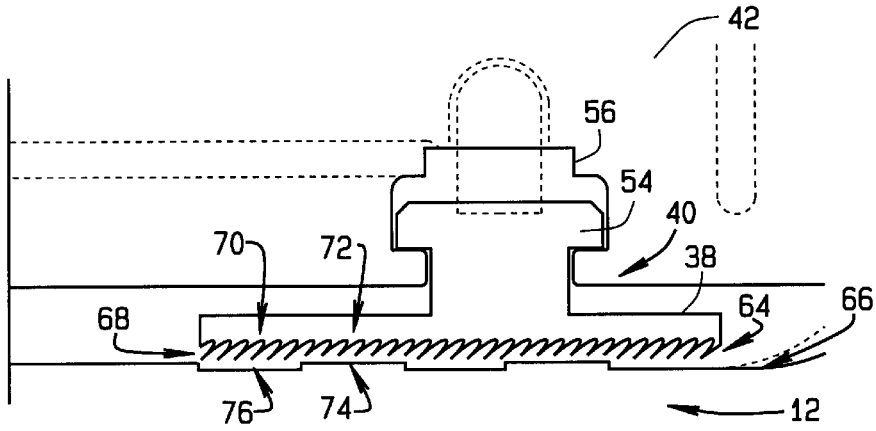
FIG. 3 is an enlarged view of the seal shown in FIG. 2 and in a cold (start-up) condition.
Figure 4:
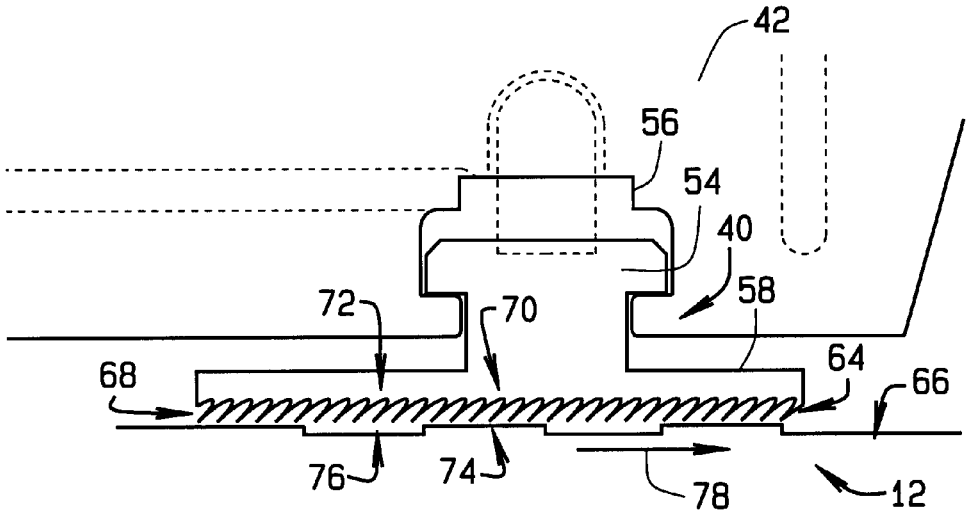
FIG. 4 is an enlarged view of the seal shown in FIG. 2 and in a hot (steady state) condition.

FIG. 2 is a cross-sectional view of an exemplary seal assembly 40 that may be used with turbine 10. FIG. 3 is an enlarged cross-sectional view of seal assembly 40 in a cold (start-up) condition. FIG. 4 is an enlarged cross-sectional view of seal assembly 40 in a hot (steady-state) condition. Diaphragm 20 includes an outer ring, portion 41 that is coupled to turbine housing 22 (shown in FIG. 1), and an inner ring portion 42. Turbine blades 16 include roots 44 that are coupled to wheels 46 extending from turbine shaft 12. Shaft 12 and wheels 46 are rotatable about an axis of rotation 48. Alternatively, seal assembly may be positioned at the rotor end, whereby the position of seal assembly is not affected at the method of sealing.

Seal assembly 40 is positioned between rotor shaft 12 and inner ring portion 42, and includes a packing ring 54 that is mounted in a groove 56 that extends circumferentially about diaphragm inner ring portion 42. Packing ring 54 includes a seal shroud 58 and a sealing member 64. In the exemplary embodiment, sealing member 64 is a plurality of axially-spaced seal teeth 64 that extend radially outwardly from seal shroud 58. Seal teeth 64 are positioned to substantially obstruct the flow of fluid from a high pressure region to a low pressure region on opposite sides of the seal assembly 40. Alternatively, packing sealing member 64 includes, but is not limited to, a brush seal (not shown) or a combination of axially-spaced seal teeth 64 and a brush seal. Turbine shaft 12 includes a packing surface 66, and packing ring 54 is coupled to turbine shaft 12 to facilitate sealing a gap 68 defined between packing surface 66 and diaphragm inner ring portion 42.

Seal teeth 64 include at least one long teeth region 70 and at least one short teeth region 72, whereas region 72 includes a plurality of teeth 64 that extend outwardly a shorter distance than the teeth 64 within region 70. Packing surface 66 includes at least one step 74 that is formed by at least one recess 76 in packing surface 66.

Seal teeth 64 force the fluid to follow a tortuous path whereby a pressure drop is created. The aggregate of the pressure drops across seal assembly 40 defines the pressure difference between the high and low pressure regions on each side of seal assembly 40. Packing ring 54 is typically biased and is movable radially when subjected to severe rotor/seal interference. In one embodiment, packing ring 54 is biased radially outwardly away from rotor shaft 12, for example, during startup and shutdown operations, such that fluid pressure between packing ring 54 and rotor shaft 12 displaces packing ring 54 radially inwardly to maintain a smaller clearance with rotor shaft 12, after rotor shaft 12 is at a desired operating space.

During a cold or startup condition, long teeth region 70 is positioned opposite recess 76 and short teeth region 72 is positioned opposite step 74. Furthermore, teeth 64 positioned within long teeth region 70 do not experience rubbing contact with packing surface 66 during the startup condition. As turbine 10 transitions to the hot or steady state condition, the temperature change of rotor shaft 12 causes an axial shift of rotor shaft 12 in the direction of arrow 78, as shown in FIG. 4. More specifically, rotor shaft 12 shifts axially relative to sealing members 64 a distance approximately equal to the width of step 74. The axial shift of rotor shaft 12 causes step 74 to facilitate sealing between step 74 and long teeth region 70, while recess 76 is positioned opposite short teeth region 72. Furthermore, because of the axial shift between the startup and steady state positions, the number of working teeth 64 prevented from rubbing facilitates operating with minimum leakage losses.

The change in axial shift by rotor shaft 12 can be measured or calculated, such as through computer modeling or analysis, for determining and configuring the axial width of step 74. Thus, step 74 is provided with an axial width approximately equal to the amount of axial shift of rotor shaft 12 relative to sealing members 64 between the startup condition and the steady state condition.

Figure 5:
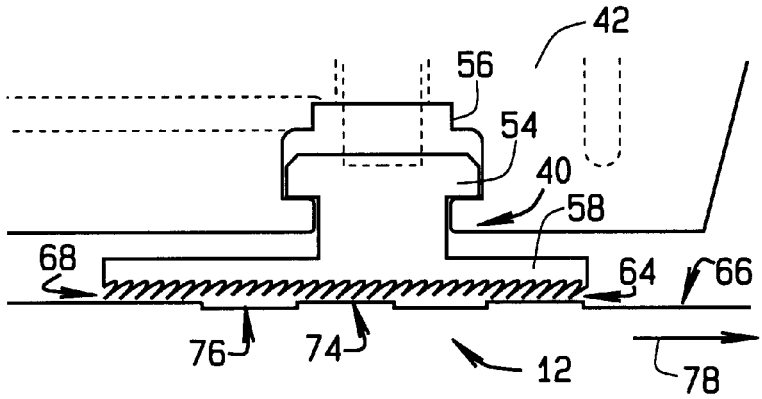
FIG. 5 is an enlarged cross-sectional view of an alternative embodiment of a seal that may be used with the steam turbine shown in a hot condition in FIG. 1.

FIG. 5 is a cross-sectional view of an alternative embodiment of seal assembly 40 about rotor shaft 12 in turbine 10 in a hot (steady state) condition. Seal assembly 40 in FIG. 5 is substantially similar to seal assembly 40 in FIGS. 3 and 4, and components in seal assembly 40 that are identical to components in seal assembly 40 used in FIGS. 3 and 4 are identified in FIG. 5 using the same reference numerals used in FIGS. 3 and 4. As shown in FIG. 5, plurality of teeth 64 have approximately the same length.

Figure 6:
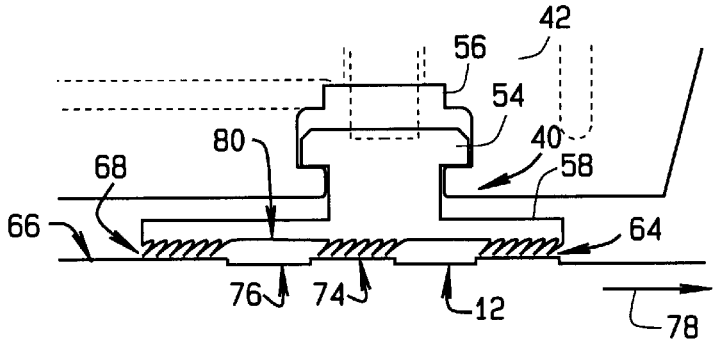
FIG. 6 is an enlarged cross-sectional view of another alternative embodiment of a seal that may be used with the steam turbine in a hot condition shown in FIG. 1.

FIG. 6 is a cross-sectional view of an alternative embodiment of seal assembly 40 about rotor shaft 12 in turbine 10 in a hot (steady state) condition. Seal assembly 40 in FIG. 6 is substantially similar to seal assembly 40 in FIGS. 3 and 4, and components in seal assembly 40 that are identical to components in seal assembly 40 used in FIGS. 3 and 4 are identified in FIG. 6 using the same reference numerals used in FIGS. 3 and 4. As shown in FIG. 6, plurality of teeth 64 have at least one region without teeth 80. In the startup condition, plurality of teeth 64 are positioned opposite recess 76 and at least one region without teeth 80 is positioned opposite step 74. In the steady state condition, rotor shaft 12 shifts axially relative to sealing members 64 a distance approximately equal to the width of step 74 so that step 74 provides a seal between step 74 and plurality of teeth 64 while recess 76 is positioned opposite at least one region without teeth 80.

In another embodiment, packing surface 66 has a plurality of teeth forming a plurality of steps and a plurality of recesses between plurality of steps for sealing engagement with plurality of teeth 64 of packing ring 54 to provide a seal between the plurality of steps and the plurality of teeth.

Figure 7:
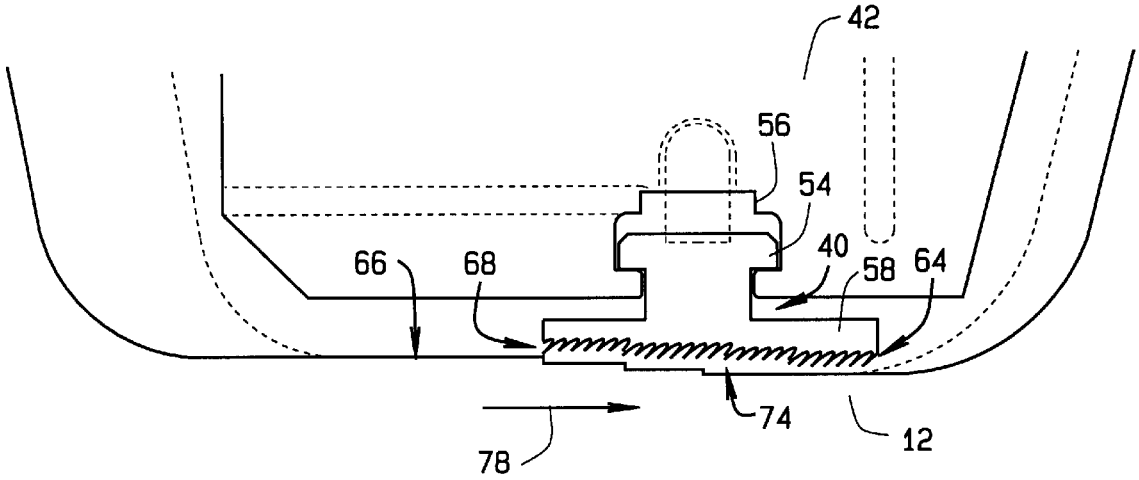
FIG. 7 is an enlarged cross-sectional view of a further alternative embodiment of a seal that may be used with the steam turbine in a cold (start-up) condition shown in FIG. 1.
Figure 8:
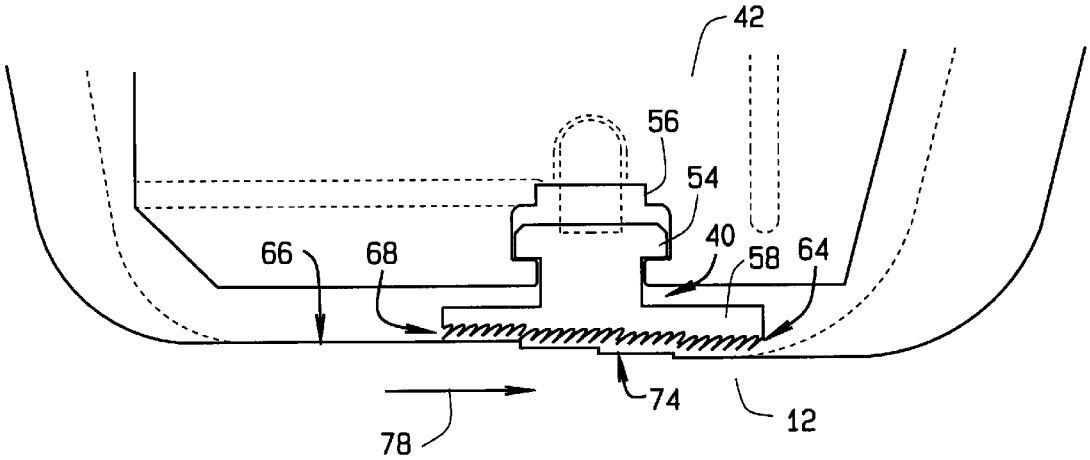
FIG. 8 is an enlarged view of the seal shown in FIG. 7 and in a hot (steady state) condition.

FIG. 7 is a cross-sectional view of an alternative embodiment of seal assembly 40 about rotor shaft 12 in turbine 10 in a cold (start-up) condition. FIG. 8 is a cross-sectional view of the alternative embodiment of seal assembly 40 in FIG. 7 in a hot (steady state) condition. Seal assembly 40 in FIG. 7 is substantially similar to seal assembly 40 in FIGS. 3 and 4, and components in seal assembly 40 that are identical to components in seal assembly 40 used in FIGS.

3 and 4 are identified in FIG. 7 using the same reference numerals used in FIGS. 3 and 4. Packing surface 66 includes a plurality of steps 74 staggered lower than packing surface 66, such that each step 74 is staggered lower than the previous step in the direction of a rotor axial movement from the startup to the steady state operation condition resulting in a "stairs" formation. Plurality of teeth 64 are similarly staggered with respect to each corresponding step 74 so as to maintain substantially the same clearance between plurality of teeth 64 and plurality of staggered steps 74 along the length of gap 68.

During startup, radial clearance increases by the step height and prevents plurality of teeth 64 from rubbing. In the steady state condition as shown in FIG. 7, rotor shaft 12 moves the amount of axial clearance or the step width to provide a seal between steps 74 and plurality of teeth 64. This reduces the radial clearance of the labyrinth thus reducing labyrinth losses and increasing turbine efficiency. In addition, the axial length of the packing surface 66 is reduced and plurality of teeth 64 are working during the steady state condition.

The above described labyrinth seal allows reduced packing leakage losses and also minimizes rubbing of teeth during transient (startup and shutdown) operation for turbines with axial differences between startup and steady state rotor and stator positions. Determining the axial shift of the rotor relative to stationary component between startup and steady state conditions facilitates designing the step to have an axial width approximately equal to the axial shift of the rotor relative to stationary component so as to minimize the amount of contact between the labyrinth teeth and the packing surface. As a result, the labyrinth seal significantly improves the performance of the turbine in a cost effective and time saving manner.

Although the invention is herein described and illustrated in association with a turbine for a steam turbine engine, it should be understood that the present invention may be used for controlling leakage of any fluid between any generally high pressure area and any generally low pressure area within a steam turbine engine. Accordingly, practice of the present invention is not limited to steam turbine engines.

While the invention has been described in terms of various specific embodiments, those skilled in the art will recognize that the invention can be practiced with modification within the spirit and scope of the claims.

What is claimed is:

1. A method for sealing between a rotary component and a stationary component, said method comprising:

positioning a seal assembly having a plurality of teeth adjacent the stationary component;

positioning a packing surface to interface with the rotary component, wherein the packing surface at the rotary component includes at least one step that has an axial width that is approximately equal to a distance the rotary component axially shifts relative to the stationary component during transition from startup to steady state operating conditions; and determining the distance the rotary component shifts axially relative to the stationary component during the transition between startup and steady-state operating conditions.

2. The method of claim 1, wherein coupling a packing surface to the rotary components further comprises coupling a packing surface including a plurality of steps and a plurality of recesses between the steps to the rotary component, wherein the plurality of teeth include at least one long teeth region that is opposite to at least one recess, and at least one short teeth region that is opposite to at least one step in the startup condition such that a seal is facilitated to be formed between the at least one step and the at least one long teeth region, following an axial shift of the rotary component relative to the stationary component.

3. The method of claim 1, wherein coupling a packing surface to the rotary components further comprises coupling a packing surface including a plurality of steps and a plurality of recesses between the steps to the rotary component, wherein the plurality of teeth including at least one region without teeth that is opposite to at least one step in the startup condition such a seal is facilitated between the at least one step and the plurality of teeth, following an axial shift of the rotary component relative to the stationary component.

4. The method of claim 1 wherein coupling a packing surface to the rotary components further comprises coupling a packing surface including a plurality of steps staggered lower than said packing surface, each step being staggered lower than the previous step to the rotary component in the direction of a rotor axial movement from the startup to the steady state operation condition, wherein the plurality of teeth are staggered with respect to the plurality of steps so as to maintain substantially the same clearance between the plurality of teeth and the plurality of staggered steps in the startup condition such that a seal is facilitated to be formed between the steps and the teeth following an axial shift of the rotary component relative to the stationary component.

5. A seal assembly for use in a turbine including at least one diaphragm and at least one rotor shaft, said seal assembly extending between the diaphragm and the rotor shaft and comprising:

a rotary component comprising a packing surface; and a stationary component comprising a plurality of teeth extending from said stationary component towards said packing surface, said packing surface comprising at least one step having an axial width that is approximately equal to a distance said rotary component axially shifts relative to said stationary component when the turbine transitions from a startup to a steady-state condition such that said seal assembly facilitates sealing between said rotary component and said stationary component.

6. A seal assembly according to claim 5 wherein said packing surface comprises a plurality of steps and a plurality of recesses, each said recess between adjacent said steps, said plurality of teeth further comprise at least one long teeth region positioned opposite at least one recess, and at least one short teeth region positioned opposite at least one step in the startup condition such that a seal is formed between said at least one step and said at least one long teeth region following an axial shift of the rotary component relative to said stationary component.

7. A seal assembly according to claim 5 wherein said packing surface comprises a plurality of steps and a plurality of recesses each said recess between adjacent said steps, said plurality of teeth further comprise at least one region without teeth, said at least one region without teeth positioned opposite to at least one step in the startup condition such that a seal is formed between said at least one step and said plurality of teeth following an axial shift of said rotary component relative to said stationary component.

8. A seal assembly according to claim 5 wherein said packing surface further comprises a plurality of steps staggered lower than said packing surface, each step being staggered lower than the previous step in the direction of a rotor axial movement from the startup to the steady state operation condition, said plurality of teeth staggered with respect to said plurality of steps so as to maintain substantially the same clearance between the plurality of teeth and the plurality of staggered steps in the startup condition such that a seal is formed between said steps and said plurality of teeth following an axial shift of said rotary component relative to said stationary component.

9. A turbine comprising:

a housing;

a rotor shaft rotatably coupled within said housing;

a diaphragm coupled to said housing; and a seal assembly extending between said rotor shaft and said diaphragm, said seal assembly comprising:

a rotary component comprising a packing surface; and a stationary component comprising a plurality of teeth extending from said diaphragm stationary housing towards said packing surface to provide a seal therebetween, said packing surface comprising at least one step having an axial width that is approximately equal to a distance of axial shift of said rotary component relative to said stationary component when the turbine transitions from a startup to a steady state condition such that said seal assembly facilitates sealing between said rotary component and said stationary component.

10. A turbine according to claim 9 wherein said packing surface comprises a plurality of steps and a plurality of recesses, each said recess between adjacent said steps, said plurality of teeth further comprise at least one long teeth region positioned opposite at least one recess, and at least one short teeth region positioned opposite at least one step in the startup condition such that a seal is formed between said at least one step and said at least one long teeth region following an axial shift of said rotary component relative to said stationary component.

11. A turbine according to claim 9 wherein said packing surface comprises a plurality of steps and a plurality of recesses each said recess between adjacent said steps, said plurality of teeth further comprise at least one region without teeth, said at least one region without teeth positioned opposite to at least one step in the startup condition such that a seal is formed between said at least one step and said plurality of teeth following an axial shift of said rotary component relative to said stationary component.

12. A turbine according to claim 9 wherein said packing surface further comprises a plurality of steps staggered lower than said packing surface, each step being staggered lower than the previous step in the direction of a rotor axial movement from the startup to the steady state operation condition, said plurality of teeth staggered with respect to said plurality of steps so as to maintain substantially the same clearance between the plurality of teeth and the plurality of staggered steps in the startup condition such that a seal is formed between said steps and said plurality of teeth following an axial shift of said rotary component relative to said stationary component.

* * * * *